US011286074B2

(12) United States Patent
Tsuruta

(10) Patent No.: US 11,286,074 B2
(45) Date of Patent: Mar. 29, 2022

(54) ASEPTIC FILLING AND PACKAGING APPARATUS, AND METHOD OF ASEPTICALLY FILLING PLASTIC FILM PACKAGE BAG WITH MATERIAL

(71) Applicant: ORIHIRO ENGINEERING CO., LTD., Tomioka (JP)

(72) Inventor: Masataka Tsuruta, Tomioka (JP)

(73) Assignee: ORIHIRO ENGINEERING CO., LTD., Tomioka (JP)

( * ) Notice: Subject to any disclaimer, the term of this patent is extended or adjusted under 35 U.S.C. 154(b) by 274 days.

(21) Appl. No.: 16/336,364

(22) PCT Filed: Sep. 27, 2016

(86) PCT No.: PCT/JP2016/078477
§ 371 (c)(1),
(2) Date: Mar. 25, 2019

(87) PCT Pub. No.: WO2018/061089
PCT Pub. Date: Apr. 5, 2018

(65) Prior Publication Data

US 2019/0300219 A1 Oct. 3, 2019

(51) Int. Cl.
*B65B 55/10* (2006.01)
*B65B 55/02* (2006.01)
(Continued)

(52) U.S. Cl.
CPC ..... *B65B 55/103* (2013.01); *B65B 3/02* (2013.01); *B65B 3/04* (2013.01); *B65B 55/027* (2013.01); *B65B 55/10* (2013.01)

(58) Field of Classification Search
CPC ..... B65B 55/025; B65B 55/027; B65B 55/04; B65B 55/10; B65B 55/103; B65B 55/106; B65B 3/02
(Continued)

(56) References Cited

U.S. PATENT DOCUMENTS 3,911,640 A * 10/1975 Rausing ..... A61L 2/10 53/426
4,287,702 A * 9/1981 Corbie ..... B65B 55/025 53/282
(Continued)

FOREIGN PATENT DOCUMENTS

CN 204982802 U 1/2016
JP H01-166758 A 6/1989
(Continued)

OTHER PUBLICATIONS

English translation of Office Action dated Sep. 9, 2020 in counterpart Korean Appl. 10-2019-7010311 (5 pgs.).
(Continued)

*Primary Examiner* — Gloria R Weeks
(74) *Attorney, Agent, or Firm* — Foley & Lardner LLP

(57) ABSTRACT

The present invention aims at sterilizing a film without using liquid hydrogen peroxide. Aseptic filling and packaging apparatus 11 has supplying device 24 for gaseous hydrogen peroxide; sterilization chamber 15 through which film sheet F passes, and to which gaseous hydrogen peroxide is supplied from supplying device 24; ventilation chamber 16 through which film sheet F passes, ventilation chamber 16 being located downstream of sterilization chamber 15; ventilators F1 and F3 that ventilate ventilation chamber 16; and filling and packaging chamber 17 that is located downstream of ventilation chamber 16, wherein filling and packaging chamber 17 has film forming device 17*d* that forms film sheet F into a plastic film packaging bag in a shape of a bag, and filling device 35 that fills the plastic film packaging bag with a material.

16 Claims, 9 Drawing Sheets

(51) Int. Cl.
*B65B 3/02* (2006.01)
*B65B 3/04* (2006.01)

(58) Field of Classification Search
USPC ..... 53/425, 426
See application file for complete search history.

(56) References Cited

U.S. PATENT DOCUMENTS 4,537,007 A * 8/1985 Lattanzi ..... B65B 55/103 53/425
5,011,664 A * 4/1991 Olanders ..... B65B 55/103 422/292
5,078,976 A 1/1992 Shibauchi et al.
6,024,683 A * 2/2000 Wilkes ..... B26D 1/626 493/196
6,203,535 B1 * 3/2001 Barney ..... B29C 66/53262 604/408
6,354,061 B1 * 3/2002 Bellei ..... B65B 55/103 53/167
6,510,669 B1 * 1/2003 Bellei ..... B65B 55/103 493/213
6,638,476 B1 * 10/2003 Elias ..... B65B 55/103 134/107
6,718,735 B2 * 4/2004 Lewis, Jr ..... B65B 9/20 53/425
6,779,318 B2 * 8/2004 Wang ..... B65B 9/087 53/133.1
6,804,936 B2 * 10/2004 Kurth ..... B65B 9/213 422/27
6,957,523 B2 * 10/2005 Siccardi ..... B65B 55/02 422/82.01
7,093,405 B2 * 8/2006 Andersson ..... B65B 55/103 53/167
8,146,328 B2 * 4/2012 Tsuruta ..... B65B 41/16 53/389.4
8,337,771 B2 * 12/2012 Ferrarini ..... B65B 9/14 422/292
8,375,686 B2 * 2/2013 Caudle ..... B65B 61/186 53/426
9,371,146 B2 * 6/2016 Tsuruta ..... B65B 61/186
2002/0124526 A1 * 9/2002 Lewis, Jr. ..... B65B 9/087 53/396
2004/0123883 A1 * 7/2004 Pritchard ..... B29C 66/83221 134/63
2005/0252176 A1 * 11/2005 Pritchard ..... B65B 51/06 53/469
2010/0202919 A1 8/2010 Burgmeier et al.
2012/0017540 A1 * 1/2012 Tsuruta ..... B65B 61/186 53/425

FOREIGN PATENT DOCUMENTS

JP H431226 A 2/1992
JP 2006-509690 A 3/2006
JP 2010-534167 A 11/2010
JP 2016-083089 A 5/2016
KR 19960010578 B1 8/1996
WO WO-2010/008334 A1 1/2010
WO WO-2010/116519 A1 10/2010

OTHER PUBLICATIONS

International Search Report dated Nov. 22, 2016 in PCT/JP2016/078477 with English-language translation (4 pgs.).
English translation of Office Action dated Nov. 18, 2020 in counterpart Chinese Application No. 2016800893850 (11 pgs.).
Yearbook 2004 in China Packaging, edited by China Packaging Federation, Jun. 2005 (8 pgs.).

* cited by examiner

ASEPTIC FILLING AND PACKAGING APPARATUS, AND METHOD OF ASEPTICALLY FILLING PLASTIC FILM PACKAGE BAG WITH MATERIAL

CROSS-REFERENCE TO RELATED APPLICATIONS

This application is a National Stage Entry of International Appl. PCT/JP2016/078477, filed Sep. 27, 2016; the disclosure of which is incorporated by reference herein in its entirety.

TECHNICAL FIELD

The present invention relates to an aseptic filling and packaging apparatus that forms a film into a bag and that aseptically fills the bag with a material, such as a liquid, and a method of aseptically filling a plastic film package bag with a material, and particularly to a configuration for sterilizing a film sheet that is to be formed into package bags.

BACKGROUND ART

There has conventionally been known an aseptic filling and packaging apparatus having the function of sterilizing a film sheet that is to be formed into film package bags. WO2010/116519 discloses an apparatus that sterilizes a film sheet by passing the sheet through a sterilization tank that is filled with liquid hydrogen peroxide. The film sheet is dried in a film drying chamber downstream of the sterilization tank, then is formed into bags by a film forming apparatus, then is filled with a material, and then is sealed.

Hydrogen peroxide is harmful to a human body. Therefore, in particular, if a material in a bag is a food, a beverage or an enteral nutrition supply product, then hydrogen peroxide must be sufficiently removed in advance so that hydrogen peroxide of an amount exceeding a predetermined upper limit does not remain in the bag. However, removing liquid hydrogen peroxide requires a process of air blowing and heating that takes a considerably long time. A large space and a long time are also required to remove hydrogen peroxide from a continuously-fed film sheet by means of air blowing and heating. This leads to an increase in the size of the apparatus, as well as to degradation of a film that is caused by air-blowing and heating the film for a long time.

An object of the present invention is to provide an aseptic filling and packaging apparatus that can sterilize a film without using liquid hydrogen peroxide.

The aseptic filling and packaging apparatus of the present invention comprises:

a supplying device for gaseous hydrogen peroxide;

a sterilization chamber through which a film sheet passes, and to which gaseous hydrogen peroxide is supplied from the supplying device;

a ventilation chamber through which the film sheet passes, the ventilation chamber being located downstream of the sterilization chamber;

a ventilator that ventilates the ventilation chamber; and a filling and packaging chamber that is located downstream of the ventilation chamber, wherein the filling and packaging chamber comprises a film forming device that forms the film sheet into a plastic film packaging bag in a shape of a bag, and a filling device that fills the plastic film packaging bag with a material.

According to the present invention, a film sheet is sterilized with gaseous hydrogen peroxide. The gaseous hydrogen peroxide that adheres to the film sheet is conveyed to the ventilation chamber that is being ventilated, and is discharged together with the ventilating air. Accordingly, the process of removing hydrogen peroxide from the film sheet is simplified, and exposure of the film sheet to a high temperature is avoided.

Therefore, the present invention can provide an aseptic filling and packaging apparatus that can sterilize a film without using liquid hydrogen peroxide.

LIST OF REFERENCE NUMERALS

Figure 1:
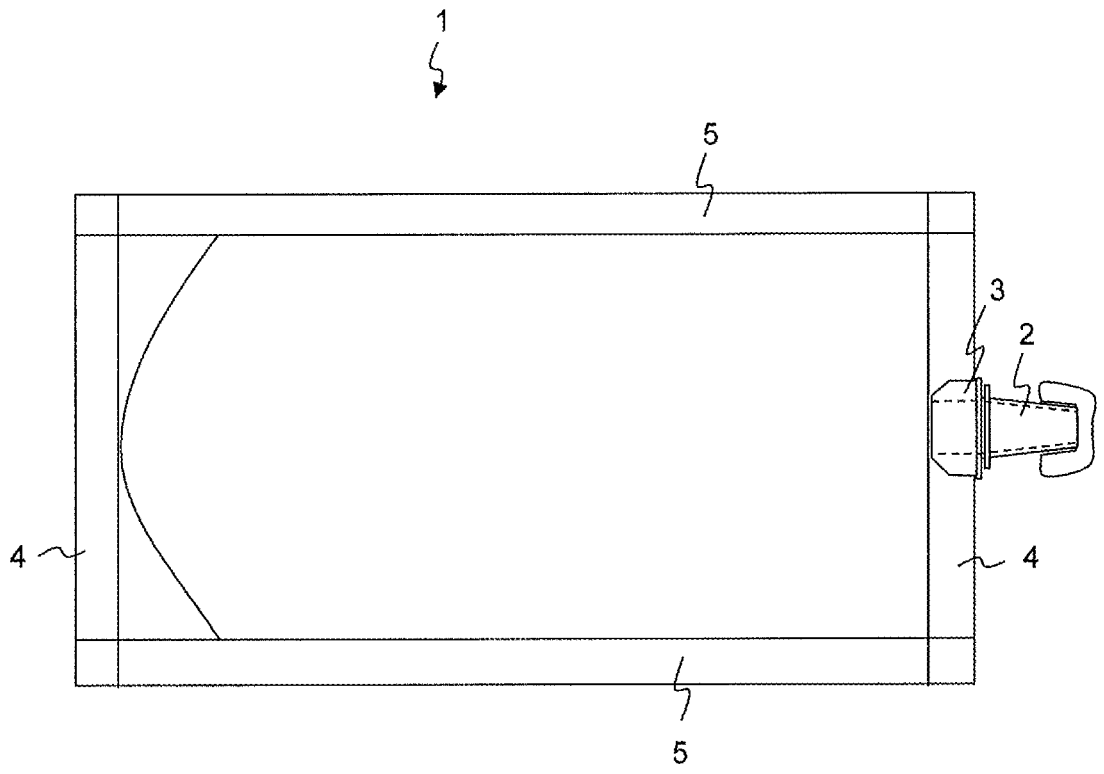
FIG. 1 is an overall view of an example of a packaging bag that is produced by an aseptic filling and packaging apparatus of the present invention.

1, 101, 201: Plastic film packaging bag
2, 102, 202: Spout
11: Aseptic filling and packaging apparatus
12: Film supplying device
13: Spout attaching device
14: Antechamber
15: Sterilization chamber
16: Ventilation chamber
17: Filling and packaging chamber
17*d*: Film forming device
18: Hydrogen decomposition column
19*a*-19*c*: First to third gates
24: Gaseous hydrogen peroxide supplying device
28: Evaporator
29: Mixer
35: Filling device
36: Longitudinal sealing mechanism
37: Lateral sealing mechanism
38: Squeezing roller
F: Film sheet
F1 to F4: First to fourth fans
L1 to L14: First to fourteenth lines
V1 to V4: First to fourth valves

DESCRIPTION OF EMBODIMENT

FIG. 1 shows an example of plastic film packaging bag 1 that is produced by an aseptic filling and packaging apparatus of the present invention. Plastic film packaging bag 1 is a self-standing bag that has a spout and that can be placed upright. The side of plastic film packaging bag 1 where spout 2 is attached is formed by folding a film along the center line thereof and by heat-sealing the overlapping edges so that base 3 of spout 2 is sandwiched between both edges. The side opposite to the side having spout 2, that is, the bottom of plastic film packaging bag 1, is formed by heat-sealing the edge while folding the film inward. The seals of both sides are referred to as longitudinal seals 4. The other two sides of plastic film packaging bag 1 are also heat-sealed, and these seals are referred to as lateral seals 5. The present invention may also be applied to manufacturing of a plastic film packaging bag without spout 2. In the following description, plastic film packaging bag 1 is a packaging bag that is filled with a material, such as a beverage or a food.

Figure 2:
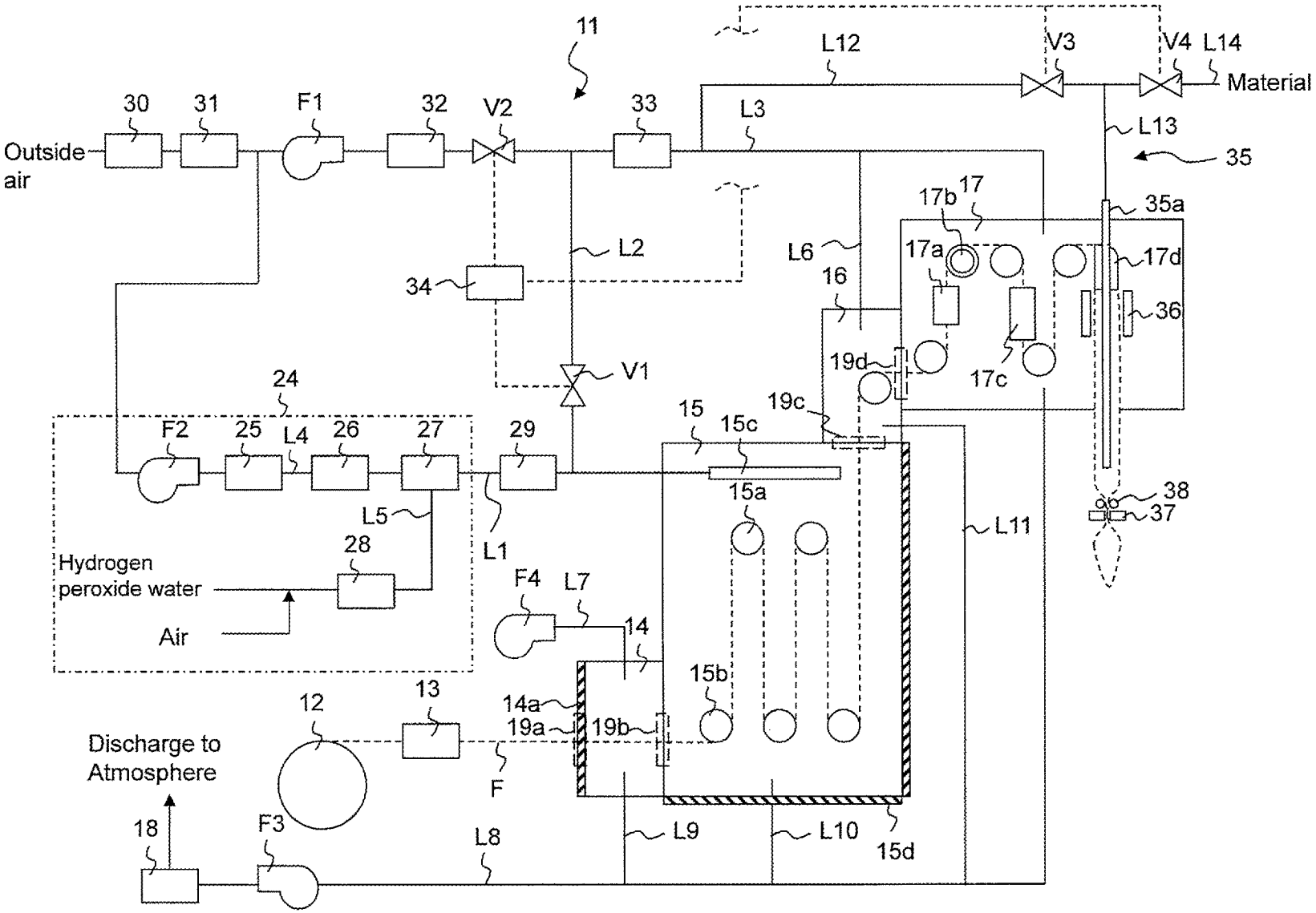
FIG. 2 is a view illustrating the overall configuration of an aseptic filling and packaging apparatus according to an embodiment of the present invention.

An embodiment of the present invention will be described with reference to the drawings. FIG. 2 is a schematic view illustrating the overall configuration of an aseptic filling and packaging apparatus according to an embodiment of the present invention. In the following description, a "fan" is used as a concept that involves a blower. "Line" may be "pipe" or "duct". In FIG. 2 and FIGS. 6-9, the broken lines indicate a film sheet and plastic film packaging bags.

Aseptic filling and packaging apparatus 11 according to the present embodiment has film supplying device 12 and spout attaching device 13. Film supplying device 12 supplies a strip-shaped continuous film (hereinafter, referred to as film sheet F) that is not in an aseptic environment (i.e., normally, having microbes thereon). Although not illustrated, film supplying device 12 holds a roll of film sheet F that is being supplied, as well as a roll of waiting film sheet F, and includes a mechanism that can switch to the waiting film sheet F without stopping the operation of aseptic filling and packaging apparatus 11 when film sheet F that is being supplied is consumed. Spout attaching device 13 attaches spout 2 to a side edge of film sheet F that is being supplied.

Film sheet F to which spout 2 was attached passes along a transportation path, which is defined by drive rollers (not shown), and enters sterilization chamber 15 via antechamber 14. Film sheet F that is supplied to sterilization chamber 15 is sterilized with gaseous hydrogen peroxide. Antechamber 14 is adjacent to sterilization chamber 15 upstream thereof and prevents the gaseous hydrogen peroxide that fills sterilization chamber 15 from leaking out of aseptic filling and packaging apparatus 11. In order to further prevent the gaseous hydrogen peroxide from leaking out of aseptic filling and packaging apparatus 11, antechamber 14 has a ventilator. Specifically, outside air is introduced to antechamber 14 by means of fourth fan F4 through seventh line L7. A small amount of gaseous hydrogen peroxide that may leak from sterilization chamber 15 into antechamber 14 is discharged together with the outside air through ninth line L9 that is connected to antechamber 14, and is then introduced to hydrogen peroxide decomposition column 18 through eighth line L8 that is connected to ninth line L9. The hydrogen peroxide is decomposed into water and oxygen in hydrogen peroxide decomposition column 18, and is discharged into atmosphere.

Figure 3A:
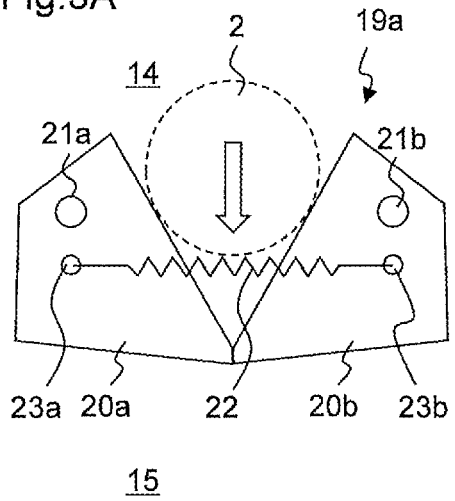
FIG. 3A is a schematic view illustrating a gate when it is closed.
Figure 3B:
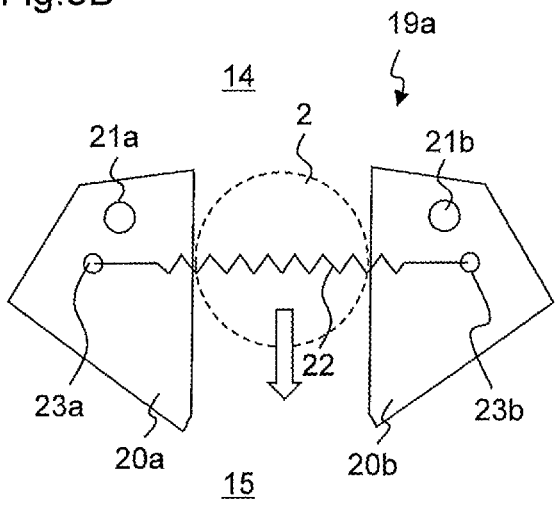
FIG. 3B is a schematic view illustrating the gate when a spout is passing through the gate.

In order to still further prevent the gaseous hydrogen peroxide from leaking out of aseptic filling and packaging apparatus 11, antechamber 14 has first gate 19*a* at the inlet thereof, which is only opened when spout 2 is passing through and is closed at the other timing. In addition, second gate 19*b* having the same configuration as first gate 19*a* is provided between antechamber 14 and sterilization chamber 15. FIGS. 3A and 3B illustrate the concept of first gate 19*a*. First gate 19*a* comprises of two gate plates 20*a*, 20*b* which can rotate about respective centers of rotation 21*a*, 21*b*. Both ends of pre-tensioned coil spring 22 are supported by supporting portions 23*a*, 23*b* of gate plates 20*a*, 20*b*, respectively. A biasing force that is caused by the tension keeps gate plates 20*a*, 20*b* in contact with each other and first gate 19*a* is closed. Thus, antechamber 14 is isolated from sterilization chamber 15. As shown in FIG. 3B, spout 2 applies a pressing force to first gate 19*a* when it passes through first gate 19*a*. Spout 2 opens first gate 19*a* against the biasing force of coil spring 22, and passes through first gate 19*a* to move from antechamber 14 to sterilization chamber 15. When spout 2 moves to sterilization chamber 15, first gate 19*a* returns to the state shown in FIG. 3A due to the biasing force of coil spring 22. Any elastic element may be used instead of coil spring 22 as long as the element is able to apply a biasing force to gate plates 20*a*, 20*b*.

Due to the abovementioned configuration, antechamber 14 is normally isolated from sterilization chamber 15, and a small amount of hydrogen peroxide that may leak into antechamber 14 when spout 2 passes through is treated in hydrogen peroxide decomposition column 18 without leaking out of aseptic filling and packaging apparatus 11.

In the present embodiment, in addition to the gates that are located at the inlet of antechamber 14 and between antechamber 14 and sterilization chamber 15, gates are also provided between sterilization chamber 15 and ventilation chamber 16, and between ventilation chamber 16 and filling and packaging chamber 17, as described later. However, gates need not to be provided at all of these locations and may be provided at at least any one of them.

In the present embodiment, the ventilator that ventilates antechamber 14 comprises of fourth fan F4 (an air supply fan) that is connected to seventh line L7 and third fan F3 (an air exhaust fan) that is provided on eight line L8. However, it is also possible to provide a branch line that branches from third line L3, and to supply air, that is supplied by first fan F1 provided on third line L3, to antechamber 14.

Antechamber 14 has electric heater 14*a*. In order to enhance the effect of sterilizing film sheet F, it is necessary to raise the concentration of gaseous hydrogen peroxide in sterilization chamber 15, and to do so, it is desirable to prevent the condensation of gaseous hydrogen peroxide. If the surface temperature of film sheet F is low, then the gaseous hydrogen peroxide partially condenses on and adheres to the surface of the film. This causes the gaseous hydrogen peroxide to be partially lost in sterilization chamber 15, and prevents an increase of the concentration of gaseous hydrogen peroxide. It is also difficult to remove the hydrogen peroxide that adheres to the surface of the film in ventilation chamber 16, which will be described later. Therefore, electric heater 14*a* is provided on a wall of antechamber 14 in order to preheat film sheet F before it enters sterilization chamber 15. Electric heater 14*a* may be provided upstream of antechamber 14 or may be omitted, depending on cases.

Sterilization chamber 15 sterilizes film sheet F having spout 2 before it is formed into a bag. Spout 2 and film sheet F are sterilized at the same time. Sterilization chamber 15 is filled with gaseous hydrogen peroxide. The concentration of the gaseous hydrogen peroxide is set in advance at a level high enough to sufficiently kill microbes, such as botulinus. In sterilization chamber 15, a plurality of upper rollers 15*a* and a plurality of lower rollers 15*b* are arranged alternately, and film sheet F is conveyed in sterilization chamber 15 along a winding path. This can reduce the volume of sterilization chamber 15, while securing an enough time for sterilization. Spray pipe 15*c* for gaseous hydrogen peroxide is provided in the upper part of sterilization chamber 15, and can disperse gaseous hydrogen peroxide uniformly in sterilization chamber 15. Sterilization chamber 15 is kept at a positive pressure relative to the outside of aseptic filling and packaging apparatus 11 in order to prevent dust from entering sterilization chamber 15.

Sterilization chamber 15 has electric heater 15*d* on the outside wall thereof. Electric heater 15*d* controls the entire sterilization chamber 15 at a constant temperature in order to maintain the concentration of the gaseous hydrogen peroxide in sterilization chamber 15. Electric heater 15*d* may be omitted depending on environmental conditions, or a heat insulator may be provided instead of electric heater 15*d*.

Sterilization chamber 15 is connected to tenth line L10 that discharges the gaseous hydrogen peroxide. Tenth line L10 is connected to hydrogen peroxide decomposition column 18 via eighth line L8, and the gaseous hydrogen peroxide that is discharged from sterilization chamber 15 is treated in hydrogen peroxide decomposition column 18.

Gaseous hydrogen peroxide is supplied from supplying device 24 for gaseous hydrogen peroxide to sterilization chamber 15. Sterilization chamber 15 is connected to supplying device 24 via first line L1. Supplying device 24 comprises of a gaseous hydrogen peroxide supplier, an air supplier and mixer 27 that mixes the gaseous hydrogen peroxide with the air. The air supplier has second fan F2 that supplies outside air, electric heater 25 and HEPA filter 26, all of which are provided on fourth line L4. Fourth line L4 branches from third line L3 on the outlet side of medium efficiency particulate air filter 31 so that dehumidified clean air can be supplied. Electric heater 25 raises the temperature of the outside air, and thereby prevents condensation of the gaseous hydrogen peroxide that is to be mixed with the outside air.

Figure 4:
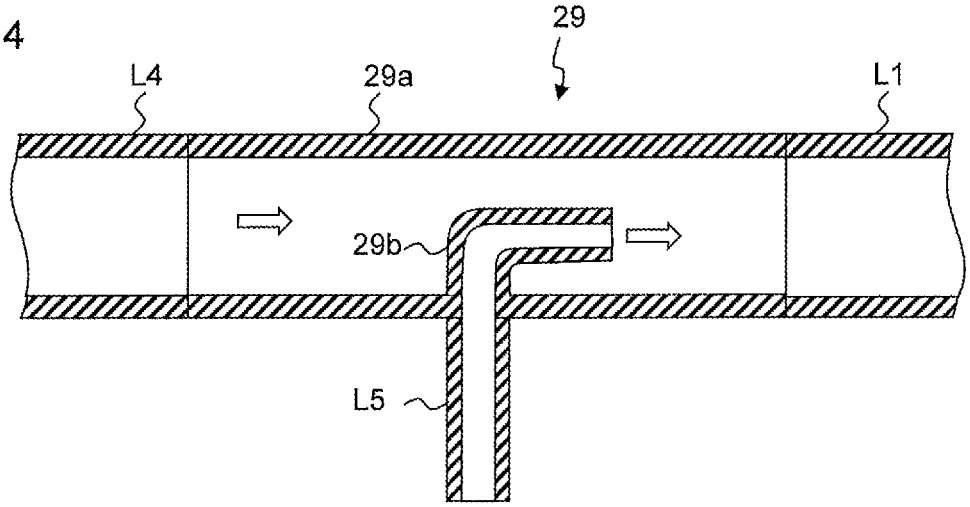
FIG. 4 is a schematic view of a mixer.

The gaseous hydrogen peroxide supplier has evaporator 28. In evaporator 28, a mixture of hydrogen peroxide water and air (an aqueous solution of hydrogen peroxide) is heated and evaporated, and gaseous hydrogen peroxide is generated. In mixer 29, the gaseous hydrogen peroxide is mixed with air, which is a carrier gas. Evaporator 28 is connected to mixer 29 via fifth line L5. FIG. 4 illustrates a schematic view of mixer 29. Mixer 29 has header 29*a* that is connected both to fourth line L4 and to first line L1 and that allows outside air to pass therethrough, and substantially L-shaped bent pipe 29*b* that is provided in header 29*a*. Bent pipe 29*b* passes through the wall of header 29*a* and communicates with fifth line L5. Inside header 29*a*, bent pipe 29*b* is bent from the connecting point with header 29*a* toward first line L1, i.e., toward sterilization chamber 15. Accordingly, gaseous hydrogen peroxide that is supplied from evaporator 28 is introduced to bent pipe 29*b* through fifth line L5, and joins the air that flows in header 29*a*. Although the temperature of the outside air that is supplied through fourth line L4 is sufficiently raised by electric heater 25, the gaseous hydrogen peroxide may be cooled due to direct contact with the outside air and may thus be condensed. Condensation tends to prevent the gaseous hydrogen peroxide from reaching a desired concentration level. In the present embodiment, the gaseous hydrogen peroxide joins the air flow after passing through bent pipe 29*b*. This allows the gaseous hydrogen peroxide to gradually contact the outside air and avoids a rapid temperature change.

Outside ventilating air is introduced to ventilation chamber 16 and to filling and packaging chamber 17. Dehumidifier 30, medium efficiency particulate air filter 31, first fan F1, electric heater 32 and HEPA and ULPA filter 33 are arranged along third line L3. HEPA and ULPA filter 33 is a combination of a HEPA filter and an ULPA filter and collects particulates with high efficiency. Thus, clean air with high temperature and low humidity is supplied to ventilation chamber 16 and to filling and packaging chamber 17 through third line L3.

Second line L2 branches from first line L1. Second line L2 merges with third line L3 on the inlet side of HEPA and ULPA filter 33, more specifically, between electric heater 32 and HEPA and ULPA filter 33. First valve V1 is provided on second line L2. Second valve V2 is provided on third line L3 on the upstream side of the merging point with second line L2. The opening/closing of first valve V1 and second valve V2 is controlled by controller 34 so that the start-up sterilization process and the production sterilization process, as described later, switch from one to the other.

Ventilation chamber 16 that allows film sheet F to pass therethrough is provided downstream of sterilization chamber 15. Although a single ventilation chamber 16 is provided in the present embodiment, a plurality of ventilation chambers may be arranged in series. Ventilation chamber 16 is provided for aeration, that is, in order to remove the gaseous hydrogen peroxide that adheres to film sheet F in sterilization chamber 15, as well as gaseous hydrogen peroxide that leaks from sterilization chamber 15 into ventilation chamber 16. Ventilation chamber 16 is connected both to sixth line L6 that branches from third line L3 and to eleventh line L11. Eleventh line L11 is connected to third fan F3 (an air exhaust fan) via eighth line L8. Clean air with high temperature and low humidity that is supplied through sixth line L6 captures the gaseous hydrogen peroxide that adheres to film sheet F and purges it through eleventh line L11. Between sterilization chamber 15 and ventilation chamber 16, third gate 19*c* is provided having the same configuration as first gate 19*a*, which is located between antechamber 14 and sterilization chamber 15 and has been described with reference to FIG. 3. Therefore, ventilation chamber 16 is substantially isolated from sterilization chamber 15. However, a small amount of gaseous hydrogen peroxide may leak out of sterilization chamber 15 into ventilation chamber 16. Clean air that is supplied through sixth line L6 can remove gaseous hydrogen peroxide that may leak into ventilation chamber 16 in this way.

In the present embodiment, a ventilator that ventilates ventilation chamber 16 comprises of first fan F1 (an air supply fan) that is provided on third line L3 and third fan F3 (an air exhaust fan) that is provided on eighth line L8. However, a dedicated fan may be provided on a dedicated line.

Filling and packaging chamber 17 is provided downstream of ventilation chamber 16. Filling and packaging chamber 17 is kept at a positive pressure relative to the outside of aseptic filling and packaging apparatus 11 in order to prevent dust or microbes from entering filling and packaging chamber 17.

Filling and packaging chamber 17 has skew correcting device 17*a* that corrects skew of film sheet F, film conveying motor 17*b* that conveys film sheet F and dancer roller 17*c* that intermittently operates to keep film sheet F at a constant tension. Film sheet F is conveyed along these devices while skew is corrected, and the tension is kept at a constant level. Meanwhile, gaseous hydrogen peroxide that may adhere to film sheet F is removed by ventilating filling and packaging chamber 17. Accordingly, filling and packaging chamber 17 has a function as a second ventilation chamber.

Filling and packaging chamber 17 has film forming device 17*d* that forms film sheet F into bag-shaped plastic film packaging bag 1. Film forming device 17*d* folds film sheet F, which is conveyed substantially in the horizontal direction, such that both edges of film sheet F in the width direction overlap each other, while turning the direction of film sheet F downward. In this process, base 3 of spout 2 is sandwiched between both edges. The film is formed into a tubular shape after exiting from film forming device 17*d*.

Filling and packaging chamber 17 has filling device 35 that fills plastic film packaging bag 1 with a material. Filling device 35 has injection pipe 35*a* that extends in the film that is formed into a tubular shape. Injection pipe 35*a* extends upward through film forming device 17*d*, and is connected to fourteenth line L14 that supplies the material via thirteenth line L13. Thirteenth line L13 is connected to twelfth line L12 that branches from third line L3 on the downstream side of HEPA and ULPA filter 33. Third valve V3 is provided on twelfth line L12. Fourth valve V4 is provided on fourteenth line L14. The opening/losing of these valves is controlled by controller 34.

Filling and packaging chamber 17 has a sealing device that seals plastic film packaging bag 1 that is filled with a material. The sealing device comprises of longitudinal sealing mechanism 36 that forms longitudinal seal 4 and lateral sealing mechanism 37 that forms lateral seal 5. Longitudinal sealing mechanism 36 heat-seals folded portions of the film. At the same time, longitudinal sealing mechanism 36 heat-seals film edges that face each other via base 3 of spout 2, and thereby finally fixes spout 2 to the film. In this way, a bag-shaped film having spout 2 is formed from a film that is formed into a tubular shape. Lateral sealing mechanism 37 has a pair of lateral sealing bars (not illustrated) that are located under the tip end of injection pipe 35*a* (a material injecting port) and that face each other via the film, and heat-seals the film in the width direction (a direction that is perpendicular to the film conveying direction that is parallel to the vertical direction, i.e., the horizontal direction) over the entire width. Lateral seal 5 forms the bottom of the tubular film, and thereby the material that is injected is held in the bag-shaped film. A portion that is partitioned by two vertically adjacent lateral seals 5 makes one plastic film packaging bag 1. Lateral sealing mechanism 37 may further include a cutter (not illustrated) that cuts the film along lateral seal 5 in the width direction. By cutting the film along lateral seal 5, separate plastic film packaging bags 1 are obtained.

Filling and packaging chamber 17 further includes a pair of squeezing rollers 38. A pair of squeezing rollers 38 is arranged below injection pipe 35*a* and above lateral sealing mechanism 37 such that they face each other via a passage for the film. Squeezing rollers 38 rotate in a direction in which the film is conveyed downward in the vertical direction and can move in a direction closer to, or away from, each other. Each squeezing roller 38 is long enough to press the film over the entire width. By closing a pair of squeezing rollers 38 when the material is injected above squeezing rollers 38, the film is squeezed with a pressing force of squeezing rollers 38 so that the material is separated in the vertical direction. The portion of the material above squeezing rollers 38 stays above squeezing rollers 38 by rotating squeezing rollers 38 while keeping them closed. While the tubular film is squeezed by squeezing rollers 38, only the portion of the material below squeezing rollers 38 is conveyed downward together with the film. The portion of the film that is squeezed by squeezing rollers 38 is heat-sealed by means of lateral sealing mechanism 37, and thereby plastic film packaging bag 1 can be manufactured with no air remaining inside. Since there is no air in the bag, oxidation of the material can be prevented. Furthermore, if there should be residual hydrogen peroxide in filling and packaging chamber 17, the hydrogen peroxide is less likely to enter plastic film packaging bag 1. A conveying mechanism (not illustrated) that conveys the film downward is provided near squeezing rollers 38.

An end of third line L3 and an end of eighth line L8 are open to filling and packaging chamber 17. With this arrangement, filling and packaging chamber 17 can be ventilated with clean air. Even If a small amount of gaseous hydrogen peroxide adheres to film sheet F, such gaseous hydrogen peroxide is virtually removed before filling of the material. In addition, fourth gate 19*d* is provided between ventilation chamber 16 and filling and packaging chamber 17. Fourth gate 19*d* has the same configuration as first gate 19*a*, which is positioned between antechamber 14 and sterilization chamber 15 and has been described with reference to FIG. 3. Thus, filling and packaging chamber 17 is substantially isolated from ventilation chamber 16. Accordingly, the inside of filling and packaging chamber 17 is virtually kept aseptic.

In the present embodiment, the ventilator that ventilates filling and packaging chamber 17 comprises first fan F1 (an air supply fan) that is provided on third line L3 and third fan F3 (an air exhaust fan) that is provided on eighth line L8. However, a dedicated fan may be provided on a dedicated line.

Figure 5:
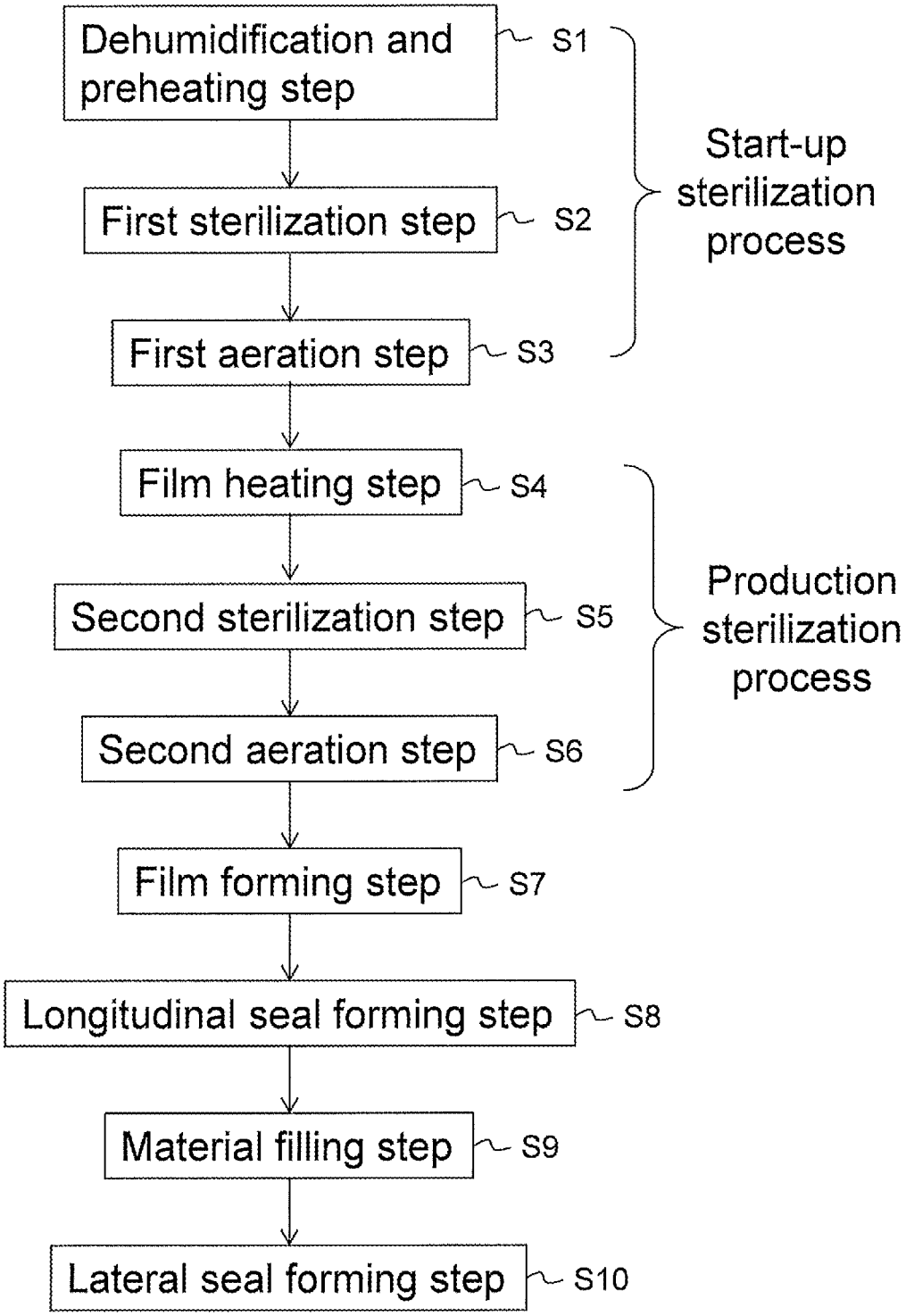
FIG. 5 is a schematic flow chart of a method of aseptic filling according to an embodiment of the present invention.

Next, an example of a method of operating aseptic filling and packaging apparatus 11 of the present embodiment will be described. FIG. 5 illustrates steps of the aseptic filling method. Aseptic filling and packaging apparatus 11 is operated in two operation modes; a start-up sterilization process and a production sterilization process. In the start-up sterilization process, the inside of aseptic filling and packaging apparatus 11 is sterilized with gaseous hydrogen peroxide before plastic film packaging bags 1 are produced by aseptic filling and packaging apparatus 11. The start-up sterilization process consists of dehumidification and preheating step S1, first sterilization step S2 and first aeration step S3. The targets to be sterilized (hereinafter, referred to as "sterilized spaces") are portions where ventilating air passes, as well as portions where a material passes, in addition to portions that are filled with gaseous hydrogen peroxide during production. The sterilized spaces include at least sterilization chamber 15, ventilation chamber 16, filling and packaging chamber 17, injection pipe 35*a*, first line L1, third line L3, sixth line 6, twelfth line L12 and thirteenth line L13. The production sterilization process consists of film heating step S4, second sterilization step S5 and second aeration step S6.

Figure 6:
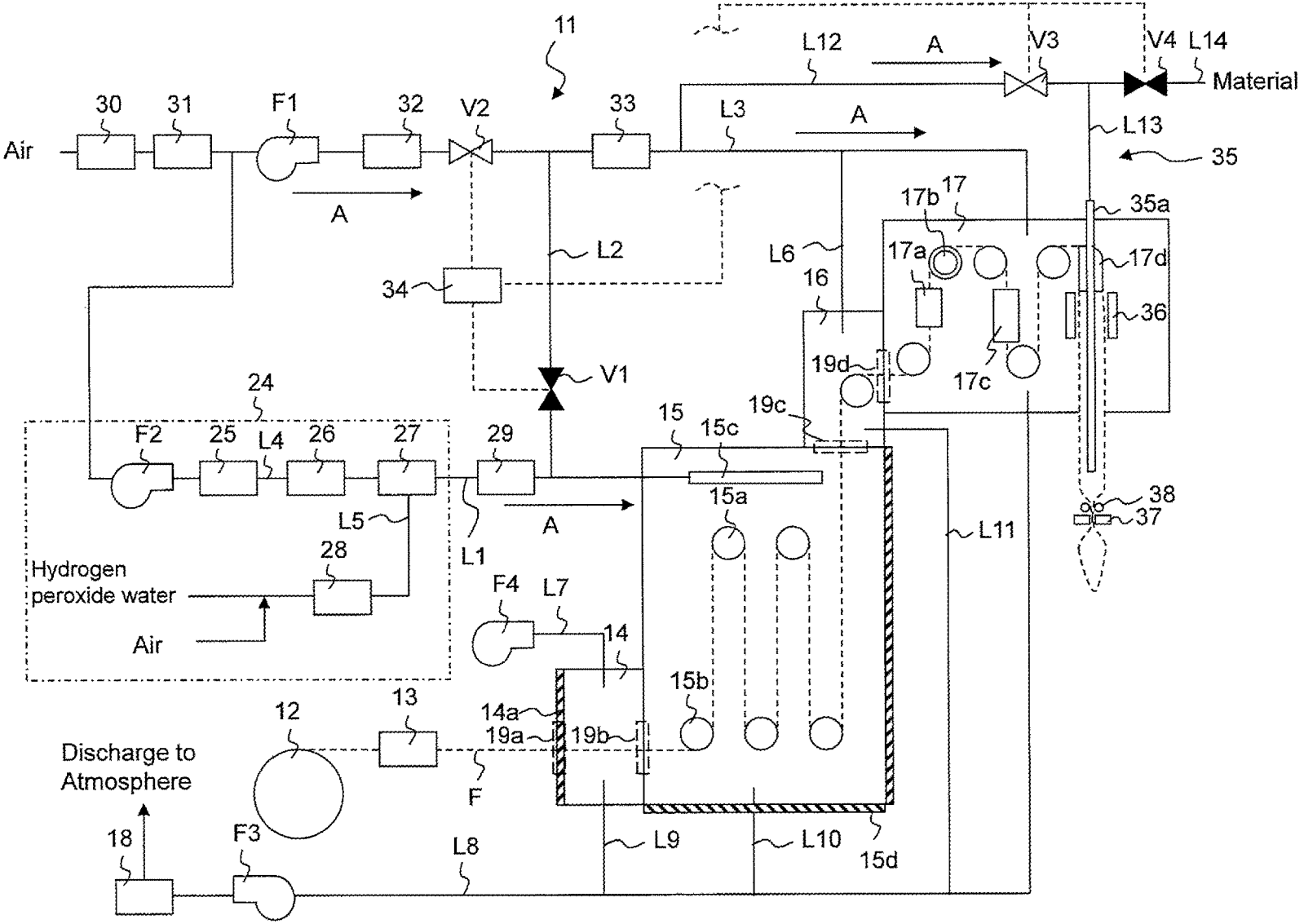
FIG. 6 is a view illustrating a dehumidification and preheating step in the start-up sterilization process.

In the start-up sterilization process, dehumidification and preheating step S1 is carried out first. FIG. 6 illustrates dehumidification and preheating step S1. In FIGS. 6-9, outside air (air) is indicated by "A", gaseous hydrogen peroxide is indicated by "H", and a mix flow of outside air and gaseous hydrogen peroxide is indicated by "A+H". First to third fans F1-F3 are activated first. Second valve V2 and third valve V3 are opened, and fourth valve V4 is closed. First valve V1 is closed, but it may be opened. Electric heaters 25 and 32 are activated in order to raise outside air temperature. A portion of the outside air is supplied to ventilation chamber 16 and to filling and packaging chamber 17 through third line L3 and sixth line 6, and is also supplied to injection pipe 35*a* through twelfth line L12 and thirteenth line L13. The remaining outside air passes through fourth line L4 via third line L3, and is then supplied to sterilization chamber 15 via first line L1. Relative humidity of the outside air is lowered due to dehumidification by dehumidifier 30 and due to heating by electric heaters 25 and 32. Thus, condensation of gaseous hydrogen peroxide is prevented in the next first sterilization step S2. If gaseous hydrogen peroxide condenses, then it takes time to remove hydrogen peroxide in ventilation chamber 16, filling and packaging chamber 17, etc., in first aeration step S1. In addition, preventing the condensation of gaseous hydrogen peroxide leads to increase in the concentration of gaseous hydrogen peroxide in the sterilized spaces. Depending on the conditions of outside air, heating by electric heaters 25 and 32 may be omitted. It is also possible not to activate first fan F1 and to close second valve V2, but in that case, first valve V1 is opened.

Figure 7:
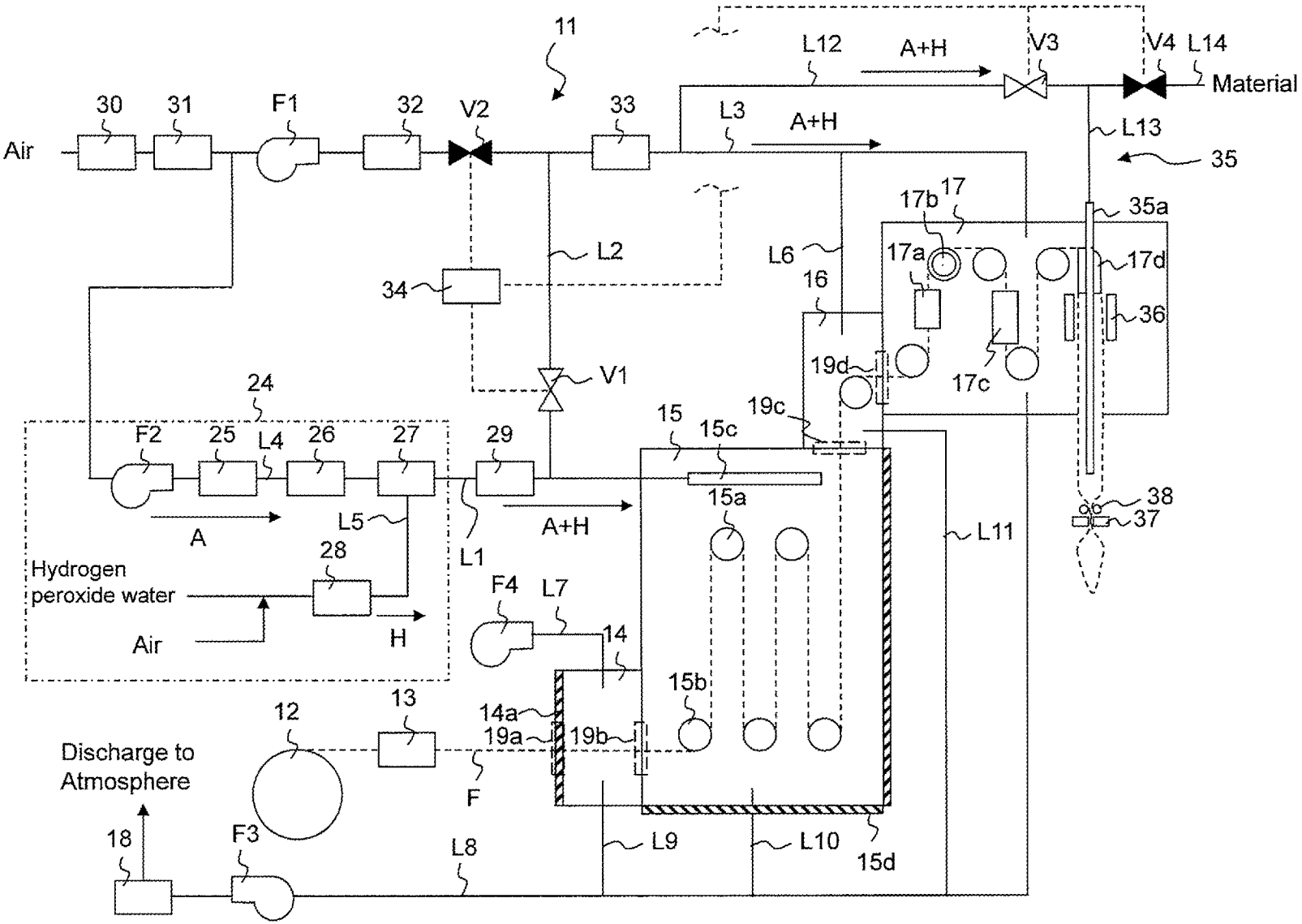
FIG. 7 is a view illustrating a sterilization step in the start-up sterilization process.

Then, first sterilization step S2 is carried out. FIG. 7 illustrates the first sterilization step. First valve V1 is opened and second valve V2 is closed first. First fan F1 is stopped. Then, hydrogen peroxide water and air are supplied to gaseous hydrogen peroxide supplying device 24 in order to produce an aqueous solution of hydrogen peroxide. The aqueous solution of hydrogen peroxide is a mixture in which hydrogen peroxide and water are mixed at a predetermined ratio. Then, the aqueous solution of hydrogen peroxide is heated and evaporated by means of evaporator 28 in order to produce gaseous hydrogen peroxide. Then, the gaseous hydrogen peroxide is mixed with an air flow, which is a carrier gas, by means of mixer 29, and the mixture is supplied to first line L1. Thus, a portion of the gaseous hydrogen peroxide is supplied to ventilation chamber 16 and to filling and packaging chamber 17 through second line L2 and third line L3, and then, ventilation chamber 16 and filling and packaging chamber 17 are sterilized. Second line L2 and third line L3, through which the gaseous hydrogen peroxide passes, are also sterilized. A portion of the gaseous hydrogen peroxide is introduced to injection pipe 35*a* via twelfth line L12 and thirteenth line L13. Thus, twelfth line L12, thirteenth line L13 and injection pipe 35*a* are sterilized. The remaining gaseous hydrogen peroxide is supplied to sterilization chamber 15 through first line L1, and first line L1 and sterilization chamber 15 are sterilized. Since second line L2 merges with third line L3 on the upstream side of HEPA and ULPA filter 33, HEPA and ULPA filter 33 is also sterilized with the gaseous hydrogen peroxide. Therefore, it is less likely to occur that microbes that adhere to HEPA and ULPA filter 33 peel off and enter filling and packaging chamber 17 in the production sterilization process. In first sterilization step S2, second fan F2 and third fan F3 preferably continue to operate. Thus, hot and dry air is supplied together with gaseous hydrogen peroxide, thereby condensation of the gaseous hydrogen peroxide is prevented and the concentration of gaseous hydrogen peroxide in the sterilized spaces increases.

Figure 8:
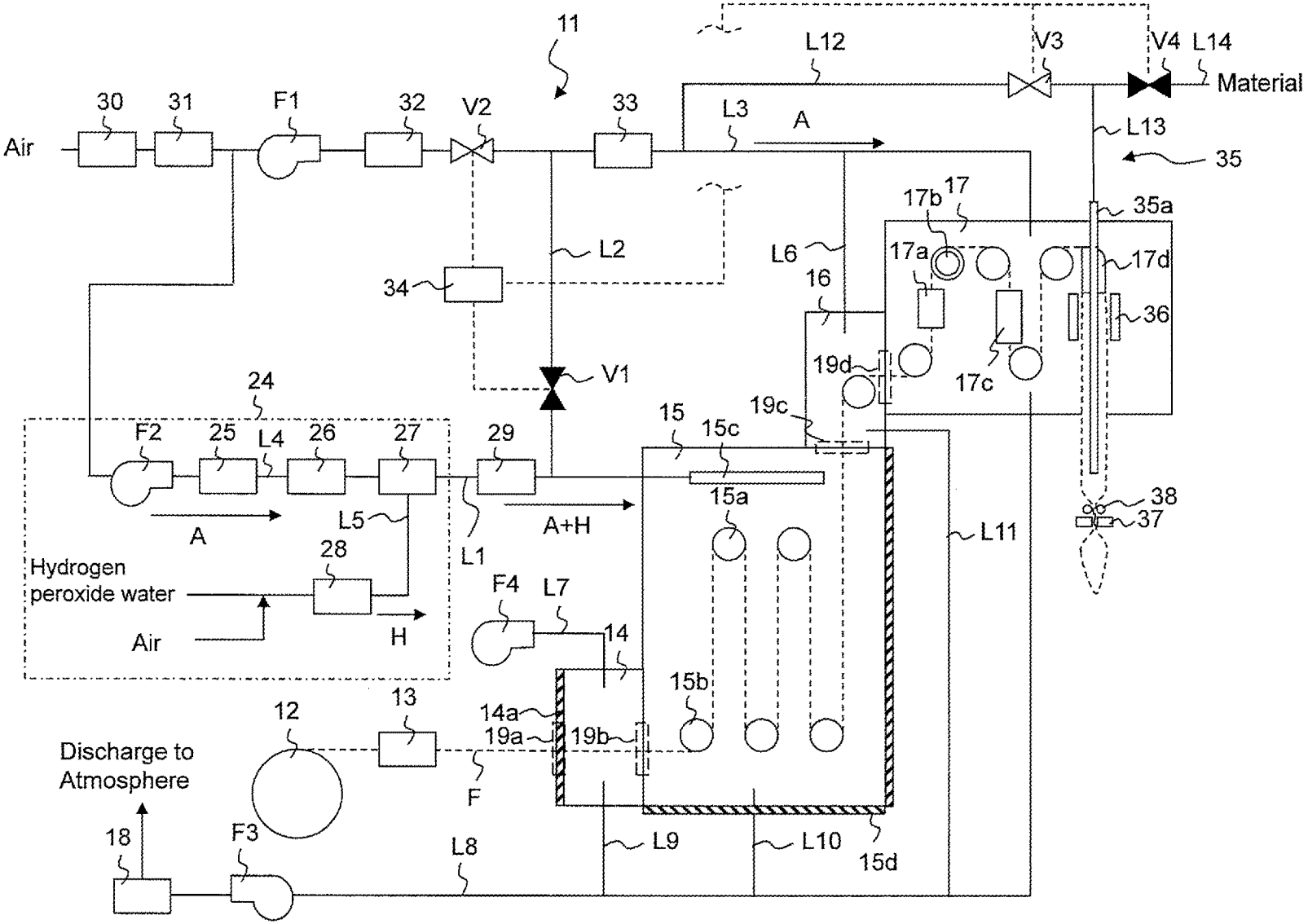
FIG. 8 is a view illustrating an aeration step in the start-up sterilization process.

Next, first aeration step S3 is carried out. FIG. 8 illustrates first aeration step S3. First valve V1 is closed in order to stop the supply of the gaseous hydrogen peroxide to ventilation chamber 16 and to filling and packaging chamber 17. First fan F1 is activated and second valve V2 is opened in order to supply hot and dry air to ventilation chamber 16 and to filling and packaging chamber 17. The gaseous hydrogen peroxide in ventilation chamber 16 and filling and packaging chamber 17 is purged. Thus, ventilation chamber 16 and filling and packaging chamber 17 are sterilized, and virtually no gaseous hydrogen peroxide remains in them. Similarly, third line L3, sixth line 6, twelfth line L12, thirteenth line L13 and injection pipe 35*a* are sterilized, and virtually no gaseous hydrogen peroxide remains in them. Meanwhile, gaseous hydrogen peroxide continues to be supplied to sterilization chamber 15, and hot and dry air also continues to be supplied to sterilization chamber 15 by means of second fan F2. This facilitates transition to the production sterilization process. The gaseous hydrogen peroxide that is contained in the discharged gas in the above-mentioned steps passes through eighth line L8, is treated in hydrogen peroxide decomposition column 18, and is then discharged to the atmosphere. First fan F1, which has a larger capacity than the other fans, can also dry injection pipe 35*a* after cleaned.

Figure 9:
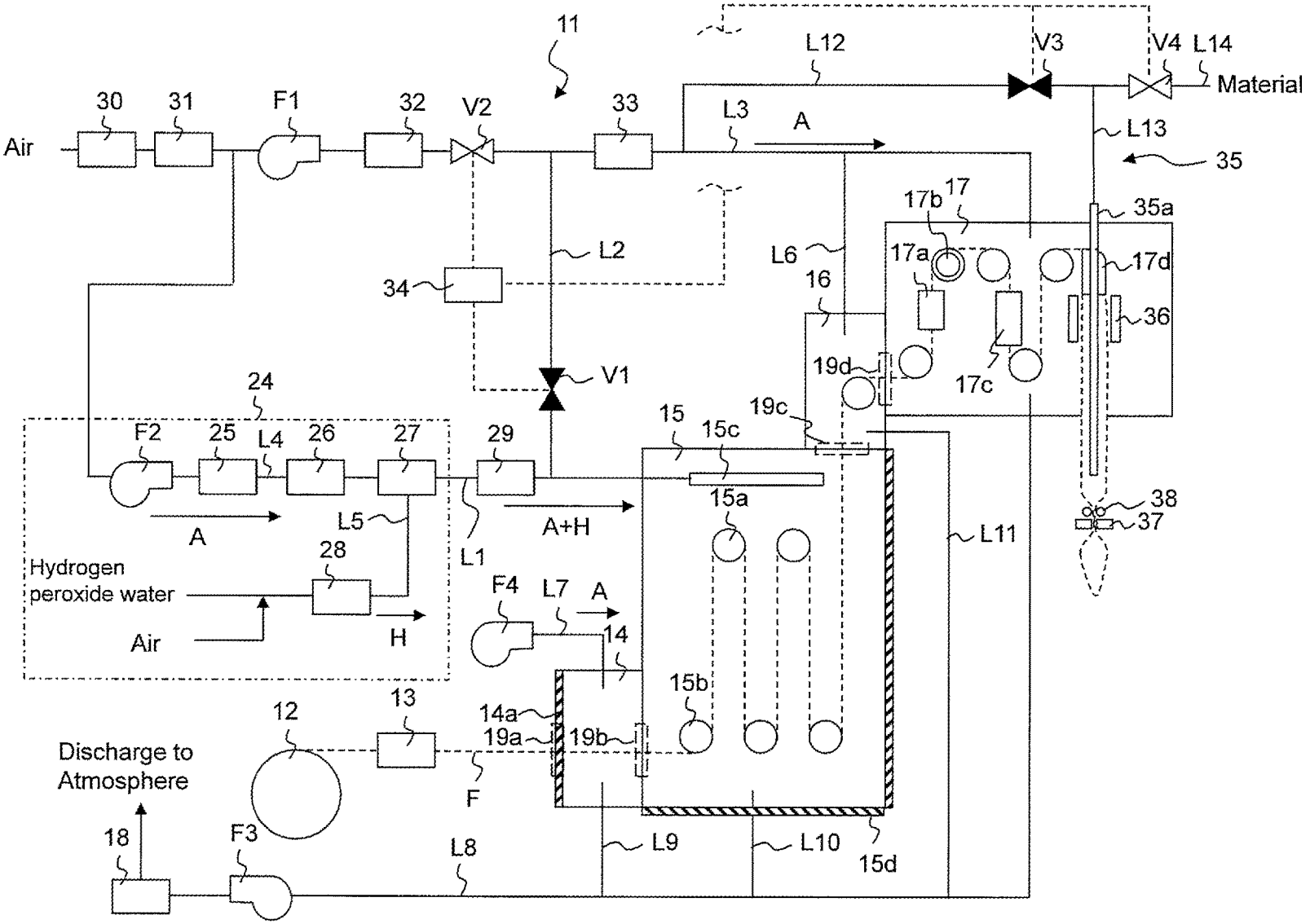
FIG. 9 is a view illustrating a sterilization step in the production process.

Next, the production sterilization process will be described. As mentioned above, the production sterilization process consists of film heating step S4, second sterilization step S5 and second aeration step S6. These are steps are the ones that are grasped from the standpoint of treatment flow of film sheet F, but these steps are actually carried out at the same time. FIG. 9 illustrates the production sterilization process.

Gaseous hydrogen peroxide is supplied to sterilization chamber 15 first. First valve V1 is kept closed and second valve V2 is kept open. Third valve V3 is closed and fourth valve V4 is opened. Thus, a material can be supplied from injection pipe 35*a* via thirteenth line L13. First to third fans F1 to F3 continue to operate. All of the gaseous hydrogen peroxide is supplied to sterilization chamber 15 through first line L1. Outside air is supplied to ventilation chamber 16 and to filling and packaging chamber 17 through third line L3. Further, fourth fan F4 is activated in order to supply outside air to antechamber 14 through seventh line L7.

Film supplying device 12 is activated, and unsterilized film sheet F enters antechamber 14 first. Since antechamber 14 is not aseptic, film sheet F is not sterilized at this stage. In film heating step S4, film sheet F is heated by means of electric heater 14*a* to a temperature that does not cause the gaseous hydrogen peroxide to be condensed on the surface. Gaseous hydrogen peroxide tends to condense when the temperature of the film is lower than that of sterilization chamber 15. Therefore, if the temperature of film sheet F is equal to or higher than that of sterilization chamber 15, then film heating step S4 may be omitted. Since antechamber 14 is ventilated by means of fourth fan F4 and third fan F3, a small amount of gaseous hydrogen peroxide that may leak from sterilization chamber 15 is treated in hydrogen peroxide decomposition column 18. Although antechamber 14 is not sterilized, this is not problematic because the function of antechamber 14 is to heat unsterilized film sheet F and to prevent gaseous hydrogen peroxide from leaking from sterilization chamber 15.

Next, second sterilization step S5 is carried out. First to fourth fans F1 to F4 continue to operate. Film sheet F enters sterilization chamber 15 and is sterilized with gaseous hydrogen peroxide. Since film sheet F is heated in antechamber 14 to a temperature that does not cause gaseous hydrogen peroxide to be condensed, the concentration of the gaseous hydrogen peroxide in sterilization chamber 15 is kept at a predetermined level. Microbes that adhere to film sheet F are killed by the gaseous hydrogen peroxide, and are discharged out of aseptic filling and packaging apparatus 11 through eighth line L8. The time duration that film sheet F needs to passes through sterilization chamber 15 depends on the types of target microbes and on the requirement of number of residual microbes per unit volume. In the present embodiment, the time duration can be short because the concentration of gaseous hydrogen peroxide in sterilization chamber 15 is kept at a high value. In addition, since the temperature of sterilization chamber 15 is, at most, slightly higher than a normal temperature, damage to film sheet F hardly occurs.

As mentioned above, sterilization chamber 15 is kept at a positive pressure relative to the outside of aseptic filling and packaging apparatus 11. This can be achieved by adjusting the flow rate of second fan F2 and third fan F3. Due to hot and dry air (a carrier air) that is supplied to sterilization chamber 15 together with gaseous hydrogen peroxide, condensation (water condensation) of gaseous hydrogen peroxide is prevented, and the concentration of gaseous hydrogen peroxide in sterilization chamber 15 can be maintained.

Next, second aeration step S6 is carried out. Film sheet F enters ventilation chamber 16. Ventilation chamber 16 is continuously ventilated by means of first fan F1 and third fan F3. Thus, gaseous hydrogen peroxide that adheres to the surface of film sheet F is removed. Third gate 19*c* that is provided between sterilization chamber 15 and ventilation chamber 16 minimizes the amount of gaseous hydrogen peroxide that leaks from sterilization chamber 15 into ventilation chamber 16. Since ventilation chamber 16 is at a normal temperature, damage to film sheet F or deformation of film sheet F, such as curl or elongation, hardly occur.

Film sheet F then enters filling and packaging chamber 17. Since filling and packaging chamber 17 is continuously ventilated by means of first fan F1 and third fan F3, a small amount of gaseous hydrogen peroxide that enters filling and packaging chamber 17 or that remains on film sheet F is substantially completely removed. Filling and packaging chamber 17 is at a normal temperature. Thus, damage to film sheet F hardly occur. The concentration of hydrogen peroxide in filling and packaging chamber 17 becomes approximately at zero by means of fourth gate 19*d* that is provided between ventilation chamber 16 and filling and packaging chamber 17.

Film sheet F is conveyed by film conveying motor 17*b*, while skew is corrected by skew correcting device 17*a* and tension is adjusted at a certain level by dancer roller 17*c*, and Film sheet F enters film forming device 17*d* (film forming step S7). Film sheet F is formed into a tubular shape by means of film forming device 17*d*, and then longitudinal seals 4 are formed by means of the longitudinal sealing device (longitudinal seal forming step S8). Because aseptic filling and packaging apparatus 11 is continuously operated, lateral seal 5 is formed at the bottom of film sheet F and the film is now in the shape of a bag that is only open at the top. Therefore, although film sheet F itself is not a part of film forming device 17*d*, the inside space of film sheet F above bottom lateral seal 5 is a space that is sterilized to the same degree as the inside of filling and packaging chamber 17, and is also a space that is isolated both from the outside of filling and packaging chamber 17 and from the outside of film sheet F. Then, a material is injected by means of injection pipe 35*a* (material filling step S9), and film sheet F is squeezed flat by means of squeezing rollers 38 in order to separate the material that fills the lower portion from the upper material. Then, lateral seal 5 is formed by means of the lateral sealing device on the flat portion that is formed by squeezing rollers 38 (lateral seal forming step S10), and lateral seal 5 is cut along the middle line thereof in the height direction. The upper half of lateral seal 5 is now the bottom portion of next plastic film packaging bag 1.

In the production sterilization process, antechamber 14, sterilization chamber 15, ventilation chamber 16 and filling and packaging chamber 17 are kept at a substantially same pressure. Thus, gaseous hydrogen peroxide can be substantially contained in sterilization chamber 15. However, it is also possible to set the pressure of antechamber 14 and ventilation chamber 16 to be slightly positive relative to sterilization chamber 15 and thereby to contain gaseous hydrogen peroxide more effectively in sterilization chamber 15.

Next, the effects of the present embodiment will be described.

(1) The shape of a spout is not limited in the present embodiment. Conventionally, a spout is sterilized by being immersed in an aqueous solution of hydrogen peroxide. Therefore, a spout needs to be shaped to allow the aqueous solution of hydrogen peroxide to reach every part of the inner surface of the spout when immersed and also to allow the hydrogen peroxide in the spout to be easily removed by air blowing after immersed. If the spout is immersed with its opening facing downward, then the inner surface may not be sterilized because of air that is trapped in the spout. If a temporary hole is provided in the spout in order to avoid this, then the temporary hole needs to be sealed in an aseptic environment. If the spout is immersed with its opening facing upward, then a large amount of an aqueous solution of hydrogen peroxide remain inside, and troublesome work is needed to remove it. By contrast, according to the present embodiment, in which gaseous hydrogen peroxide is used, a spout having a complicated shape of the inner surface can be easily sterilized and gaseous hydrogen peroxide that adheres to the inner surface can also be easily removed. In addition, the cost of plastic film packaging bag 1 can be reduced because it is easy to utilize a general-purpose spout.

(2) According to the present embodiment, degradation of a film can be prevented. Conventionally, in addition to air blowing, heating means, such as hot air or a heater, is often used to evaporate hydrogen peroxide and thereby to remove liquid hydrogen peroxide. In particular, it is difficult to rely only on air blowing in order to completely dry the inner surface of a spout where an aqueous solution of hydrogen peroxide easily remains. Therefore, the spout and the film around the spout tend to be subject to a high temperature for a long time and thereby to be easily degraded. In the present embodiment, sterilization chamber 15 is kept at a temperature that is, at most, slightly higher than a normal temperature, and ventilation chamber 16 and filling and packaging chamber 17 are at a substantially normal temperature. In addition, film sheet F passes through sterilization chamber 15 only for a short time. Accordingly, thermal degradation of a film is less likely to occur, and the reliability of plastic film packaging bag 1 can be enhanced. Furthermore, since a film is conventionally immersed in an aqueous solution of hydrogen peroxide, the film tends to be damaged more seriously by hydrogen peroxide. Skew and elongation may occur in degraded film sheet F. According to the present embodiment, in which gaseous hydrogen peroxide is used, such damage that is caused by hydrogen peroxide can be reduced.

(3) The configuration of an aseptic filling and packaging apparatus can be simplified. As described in WO 2010/116519 mentioned above, a conventional aseptic filling and packaging apparatuses has a large-volume drying chamber in order to remove liquid hydrogen peroxide. Auxiliary facilities, such as a hydrogen peroxide water storage tank, a hydrogen peroxide mist tank, a large capacity drying fan, a heater and large diameter pipes, are required. According to the present embodiment, only ventilation chamber 16 with a relatively small volume for removing hydrogen peroxide is required, and substantially no facilities are required within ventilation chamber 16. Furthermore, filling and packaging chamber 17 has the function of ventilation, in addition to the major function, which is filling and packaging. Thus, according to the present embodiment, it is possible to reduce the size or installation area of aseptic filling and packaging apparatus 11 and also to reduce the cost of aseptic filling and packaging apparatus 11. In addition, an air knife dedicated to drying a spout may be conventionally installed at a predetermined position. In that case, a spout must be exactly aligned with the air knife. However, the present embodiment does not require any equipment for that purpose.

(4) The time for the production sterilization process can be shortened. As mentioned above, air blowing or heating are employed in order to remove liquid hydrogen peroxide, but it takes a long time to remove liquid hydrogen peroxide by these methods. By contrast, the present embodiment only requires a short time to remove hydrogen peroxide because gaseous hydrogen peroxide is used.

(5) The time for the start-up sterilization process can be shortened. Conventionally, the start-up sterilization process is carried out before the production sterilization process, as in the present embodiment. In a conventional start-up sterilization process, mist is produced from an aqueous solution of hydrogen peroxide; aseptic chambers, such as a drying chamber and a filling and packaging chamber, are preheated; hydrogen peroxide mist is sprayed in the aseptic chambers, and then the aseptic chambers are dried. The preheating step is carried out in order to enhance the sterilization effect by preheating the aseptic chambers before hydrogen peroxide mist is sprayed, but it takes a long time. The drying step takes a long time to dry the aseptic chambers completely. In an example, a conventional start-up sterilization step requires about two hours. By contrast, the start-up sterilization process of the present embodiment is carried out in three steps; the dehumidification and preheating step, the first sterilization step and the first aeration step. The dehumidification and preheating step does not take a long time because it is sufficient to heat the sterilized spaces in order to prevent condensation of gaseous hydrogen peroxide. Therefore, according to the present embodiment, the time for the start-up sterilization process can be reduced at least to half the time required in a conventional process.

(6) The efficiency of using a film can be improved. Normally, the aseptic filling and packaging apparatus is continuously operated, but operations and halts may be repeated for the inspection of facilities. When an aseptic filling and packaging apparatus in operation is halted, a portion of a film sheet in the aseptic filling and packaging apparatus, such as a portion that remains immersed in an aqueous solution bath of hydrogen peroxide, significantly deteriorates and may cause curl, elongation or poor sealing when the operation of the aseptic filling and packaging apparatus resumes. Therefore, the film sheet may have to be disposed of. However, since it is difficult to dispose of only a portion of a film sheet in the aseptic filling and packaging apparatus, the entire length of the film sheet in the aseptic filling and packaging apparatus is often taken out. As mentioned above, a film sheet in the aseptic filling and packaging apparatus is conveyed along a winding path by means of many rollers, and has a considerable length. By contrast, according to the present embodiment, film sheet F is less likely to deteriorate in aseptic filling and packaging apparatus 11 during a halt, and therefore, the amount of a film to be disposed of is reduced, and the efficiency of using a film is improved.

Figure 10A:
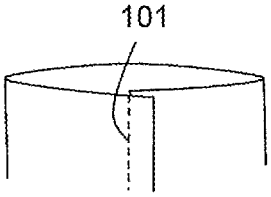
FIG. 10A is a schematic view of a standard lap seal.
Figure 10B:
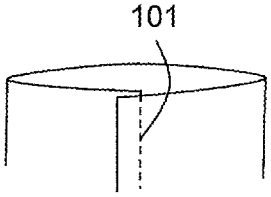
FIG. 10B is a schematic view of a reverse lap seal.
Figure 10C:
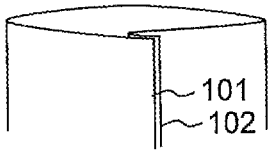
FIG. 10C is a schematic view of a fin seal.

(7) A lap seal can be easily adopted. Generally, a lap seal and a fin seal are widely used as a structure of sealing portion of plastic film packaging bag 1. FIGS. 10A and 10B conceptually illustrate a lap seal, and FIG. 10*c* conceptually illustrates a fin seal. The seal in FIG. 10A is called a standard lap seal, and the seal in FIG. 10B is called a reverse lap seal. In a lap seal, one end surface 101 of the film faces the inside of a plastic film packaging bag, and in a reverse lap seal, both end surfaces 101, 102 of film are positioned out of a plastic film packaging bag. Films are typically produced in a co-extrusion process or in a lamination process, and in films that are produced by the co-extrusion process, a material that easily absorbs liquid hydrogen peroxide, such as nylon, is often used. For this reason, if a co-excluded film is adopted for a lap seal, then hydrogen peroxide may be eluted from the end surface of the film and may enter a plastic film packaging bag. However, the possibility can be reduced because gaseous hydrogen peroxide is not absorbed by a material such as nylon. It should be noted that it is also possible to further limit the absorption of hydrogen peroxide by melting and cutting the end surface of film F so that no layer that easily absorbs hydrogen peroxide, such as nylon, is exposed to the outside.

(8) It is easy to maintain gaseous hydrogen peroxide at an appropriate concentration level because the concentration of the gaseous hydrogen peroxide can be measured by means of a gas sensor. Conventionally, it is difficult to control the concentration because mist of hydrogen peroxide is sprayed.

(9) The amount of use of hydrogen peroxide can be reduced because gaseous hydrogen peroxide is used. Together with this, the amount of use of vapor and water can also be reduced, and the environmental load and the operation cost can be reduced.

Figure 11:
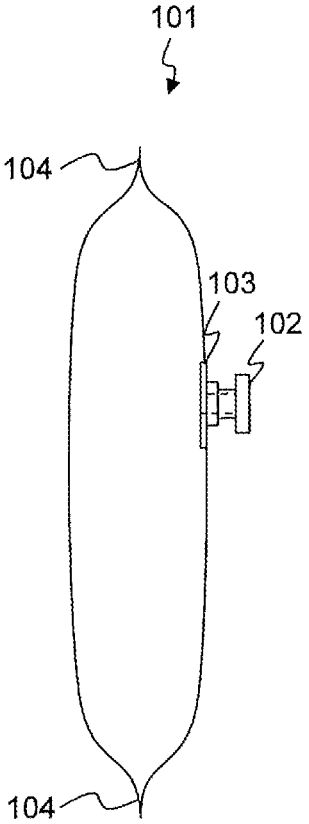
FIG. 11 is an overall view of an example of another packaging bag.
Figure 12:
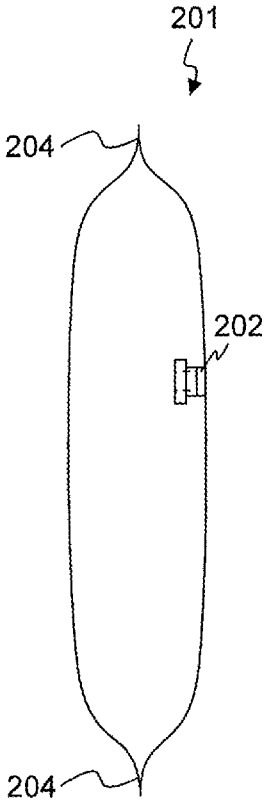
FIG. 12 is an overall view of an example of yet another packaging bag.

An embodiment of the present invention has been described above in detail, but the present invention can also be applied to a plastic film packaging bag having a spout attached to the outer surface or the inner surface of the bag. FIG. 11 illustrates an example of the overall view of another plastic film packaging bag. Spout 102 is attached to plastic film packaging bag 101. Spout 102 is attached, not to longitudinal seal 104, but to the central area of the outer surface of the bag. Base 103 is attached to the inside of plastic film packaging bag 101, and spout 102 that is formed integrally with base 103 extends to the outside of plastic film packaging bag 101 through a hole (not illustrated) that is made on plastic film packaging bag 101. FIG. 12 illustrates an example of the overall view of yet another plastic film packaging bag. Spout 202 is attached to plastic film packaging bag 201. Spout 102 is attached, not to longitudinal seal 104, but to the central area of the inner surface of the bag.

The invention claimed is:

1. An aseptic filling and packaging apparatus, comprising:

a supplying device for gaseous hydrogen peroxide;

a sterilization chamber through which a film sheet passes, and to which gaseous hydrogen peroxide is supplied from the supplying device in a production sterilization process;

a ventilation chamber through which the film sheet passes, the ventilation chamber being located downstream of the sterilization chamber;

a ventilator that ventilates the ventilation chamber, wherein the ventilator introduces outside air from outside of the aseptic filling and packaging apparatus and exhausts the outside air to the outside of the aseptic filling and packaging apparatus;

a filling and packaging chamber that is located downstream of the ventilation chamber, wherein the filling and packaging chamber comprises a film forming device that forms the film sheet into a plastic film packaging bag in a shape of a bag, and a filling device that fills the plastic film packaging bag with a material; and a gate that is provided between the sterilization chamber and the ventilation chamber, wherein the gate allows the film sheet to pass therethrough.

2. The aseptic filling and packaging apparatus according to claim 1, wherein the filling and packaging chamber is ventilated by the ventilator.

3. The aseptic filling and packaging apparatus according to claim 2, further comprising an antechamber that is located upstream of and adjacent to the sterilization chamber, wherein the film sheet passes through the antechamber and the antechamber is ventilated by the ventilator.

4. The aseptic filling and packaging apparatus according to claim 3, wherein the antechamber has a heater.

5. The aseptic filling and packaging apparatus according to claim 3, further comprising a spout attaching device that is located upstream of the antechamber and that attaches a spout to the film sheet.

6. The aseptic filling and packaging apparatus according to claim 1, wherein the supplying device for gaseous hydrogen peroxide has an evaporator that evaporates hydrogen peroxide and a mixer that mixes evaporated hydrogen peroxide, which is supplied from the evaporator, with outside air.

7. The aseptic filling and packaging apparatus according to claim 6, wherein the mixer comprises a header through which the outside air flows and a bent pipe that is connected to the evaporator, wherein the bent pipe is bent in the header, from a connecting point with the header, toward the sterilization chamber.

8. The aseptic filling and packaging apparatus according to claim 6, wherein the supplying device comprises a fourth line that supplies outside air to the mixer, and a heater is provided on the fourth line.

9. The aseptic filling and packaging apparatus according to claim 1, wherein a heater is provided on at least a part of an outside wall of the sterilization chamber.

10. The aseptic filling and packaging apparatus according to claim 1, wherein the filling and packaging chamber comprises squeezing rollers that press a portion of the plastic film packaging bag, the portion being filled with a material, and wherein the squeezing rollers thereby separate the material in a direction in which the film sheet is conveyed.

11. An aseptic filling and packaging apparatus, comprising:

a supplying device for gaseous hydrogen peroxide;

a sterilization chamber through which a film sheet passes, and to which gaseous hydrogen peroxide is supplied from the supplying device;

a ventilation chamber through which the film sheet passes, the ventilation chamber being located downstream of the sterilization chamber;

a ventilator that ventilates the ventilation chamber;

a filling and packaging chamber that is located downstream of the ventilation chamber, wherein the filling and packaging chamber comprises a film forming device that forms the film sheet into a plastic film packaging bag in a shape of a bag, and a filling device that fills the plastic film packaging bag with a material, wherein the filling and packaging chamber is ventilated by the ventilator;

an antechamber that is located upstream of and adjacent to the sterilization chamber, wherein the film sheet passes through the antechamber and the antechamber is ventilated by the ventilator;

a first line that connects the supplying device to the sterilization chamber;

a second line that branches from the first line; and a third line that introduces outside air to the ventilation chamber and to the filling and packaging chamber, wherein the second line merges with the third line.

12. The aseptic filling and packaging apparatus according to claim 11, further comprising a filter that is provided on the third line and that filters the outside air, wherein the second line merges with the third line on an inlet side of the filter.

13. The aseptic filling and packaging apparatus according to claim 11, further comprising a valve that is provided on the second line, and a controller configured to control the valve, wherein the controller is configured to control opening and closing of the valve such that a start-up sterilization process and the production sterilization process are switched from one to the other, wherein, in the start-up sterilization process, gaseous hydrogen peroxide is supplied to the ventilation chamber and to the filling and packaging chamber via the second line and the third line, and in the production sterilization process, outside air is supplied to the ventilation chamber and to the filling and packaging chamber via the third line.

14. An aseptic filling and packaging apparatus, comprising:

a supplying device for gaseous hydrogen peroxide;

a sterilization chamber through which a film sheet passes, and to which gaseous hydrogen peroxide is supplied from the supplying device;

a ventilation chamber through which the film sheet passes, the ventilation chamber being located downstream of the sterilization chamber;

a ventilator that ventilates the ventilation chamber;

a filling and packaging chamber that is located downstream of the ventilation chamber, wherein the filling and packaging chamber comprises a film forming device that forms the film sheet into a plastic film packaging bag in a shape of a bag, and a filling device that fills the plastic film packaging bag with a material;

wherein the filling and packaging chamber is ventilated by the ventilator, an antechamber that is located upstream of and adjacent to the sterilization chamber, wherein the film sheet passes through the antechamber and the antechamber is ventilated by the ventilator;

a spout attaching device that is located upstream of the antechamber and that attaches a spout to the film sheet;

a gate that is located at at least any one of: at an inlet of the antechamber, between the antechamber and the sterilization chamber, between the sterilization chamber and the ventilation chamber or between the ventilation chamber and the filling and packaging chamber, wherein each gate comprises a gate plate and an elastic element that gives a biasing force to the gate plate in order to close the gate plate; and the gate plate is opened against the biasing force by a pressing force of the spout that is moving and thereby allows the spout to pass therethrough.

15. A method of aseptically filling a plastic film packaging bag, the method comprising:

passing a film sheet through a sterilization chamber that is filled with gaseous hydrogen peroxide in a production sterilization process;

passing the film sheet, which exits from the sterilization chamber, through a ventilation chamber that is being ventilated by a ventilator;

passing the film sheet, which exits from the ventilation chamber, through a filling and packaging chamber that is being ventilated; and forming the film sheet into a plastic film packaging bag in a shape of a bag and filling the plastic film packaging bag with a material in the filling and packaging chamber, wherein the ventilator introduces outside air from outside of the aseptic filling and packaging apparatus and exhausts the outside air to the outside of the aseptic filling and packaging apparatus, and the film sheet passes through a gate that is provided between the sterilization chamber and the ventilation chamber.

16. The method of aseptically filling a plastic film packaging bag according to claim 15, wherein the ventilation chamber and the filling and packaging chamber are sterilized with gaseous hydrogen peroxide before passing the film sheet through the sterilization chamber.

* * * * *